US005291944A

United States Patent [19]

Sanz et al.

[11] Patent Number: 5,291,944

[45] Date of Patent: Mar. 8, 1994

[54] HEAT EXCHANGER

[76] Inventors: Delio Sanz; Gary M. Sanz, both of 34 Mellowood Drive, Willodale, Canada, M2L 2E3

[21] Appl. No.: 981,757

[22] Filed: Nov. 25, 1993

[51] Int. Cl.[5] ..... F28D 7/16

[52] U.S. Cl. ..... 165/159; 165/910; 165/157

[58] Field of Search ..... 165/157, 159, 910

[56] References Cited

U.S. PATENT DOCUMENTS

| | | | |
|---|---|---|---|
| 3,265,128 | 8/1966 | Legrand | 165/159 |
| 4,105,067 | 8/1978 | Bovagne | 165/159 |
| 4,357,991 | 11/1982 | Cameron | 165/199 |
| 4,622,921 | 11/1986 | Cameron et al. | 122/7 C |
| 5,044,431 | 9/1991 | Cameron | 165/158 |

*Primary Examiner*—John Rivell

*Attorney, Agent, or Firm*—Polster, Lieder, Woodruff & Lucchesi

[57] ABSTRACT

Heat exchange apparatus (10) for use in large vessels exposed to high thermal expansion and prone to acoustical noise and tube bundle resonance associated with high gas velocity comprises a shell (12) having a fluid inlet (14) and a fluid outlet (16). A plurality of heat exchange tubes (18, 20) are housed in the shell and extend parallel to each other substantially the length of the shell. The tubes are arranged so there is a central core (22) devoid of tubes, an inner layer (24) of tubes surrounding the central core, and an outer layer (26) of tubes surrounding the inner layer. The inner and outer layers of tubes are divided into segments (28, 30). The pattern (34) of the tubes in one segment (28A) is different from the pattern (32) of the tubes in the adjoining arcuate and radial segments (28B, 28L, 30A) so a checkered pattern of two different tube layouts is formed to reduce acoustical noise and prevent bundle resonance. In addition, fluid flowing radially to or from the central core has an equidistant flow path, uniform resistance to fluid flow and a constant mean flow velocity through both layers regardless of the flow direction. Baffles (38U, 38L, 40) and end supports (36T, 36B) support the tubes and are arranged such that they produce a serpentine fluid flow path through the shell, along the length of the tubes, to increase heat transfer. To further reduce noise, additional support plates (44) are unequally spaced within the tube bundle.

19 Claims, 5 Drawing Sheets

HEAT EXCHANGER

BACKGROUND OF THE INVENTION

This invention relates to shell and tube heat exchangers and, more particularly, to a heat exchanger having an improved tube and shell configuration.

In heat exchangers, employing tubes for carrying heating or cooling fluids, it is known that the tubes can be configured in various patterns or configurations. See, for example, U.S. Pat. Nos. 5,044,431 and 4,357,991. As shown or disclosed therein, the heat exchange tubes are configured in circular or elliptical patterns, with certain spacing requirements between the tubes being specified. In the '991 patent, the tubes extend vertically of a shell and are arranged in a concentric pattern. In the '431 patent, the tubes also extend vertically of a shell but are either arranged in a generally elliptical pattern, or in a square or rectangular pattern with each side of the square or rectangle concavely curving. In each instance, the tube arrangement is to facilitate compact tube packing while maintaining uniform fluid flow through the individual tubes.

It is known that in a heat exchanger, the fluid flows into the heat exchanger at one point, is directed through the tube arrangement both by placement of the tubes themselves, as well as by baffles, for example, and then exits the heat exchanger at a second location To maximize heat transfer, not only is the tube arrangement as discussed in the above referenced patents important, but so are matters such as uniform flow paths, the prevention of acoustical noise, resonance or vibration, the physical size of heat exchanger required for the particular tasks, etc. While the various tube configurations shown and described in these patents try to address some of these problems, it will be noted with respect to the above referenced patents, that there are still non-uniform flow paths (for example, at the corners of the various tube layouts of the '431 patent) which result in some of the problems discussed above. On the other hand, some heat exchangers built in accordance with the '991 patent are known to generate acoustical noise. Other arrangements are, however, possible by which not only is more efficient heat transfer achieved, but in which these other problems are solved.

In addition to the aforementioned, another significant factor in these prior heat exchangers is their cost. One problem attendant with some earlier heat exchangers is that due to their size, they could only be manufactured on site. Fabricating the exchanger in a shop (where fabrication costs are much lower), transporting the unit to the site, and installing it there is preferable.

SUMMARY OF THE INVENTION

Among the several objects of the present invention may be noted the provision of an improved tube layout for a heat exchanger; the provision of such a layout in which the tubes and their associated baffles are arranged to produce a serpentine pattern of flow through the exchanger for more efficient heat transfer; the provision of such an arrangement for providing an increased efficiency regardless of whether a heating or cooling fluid flows around and through the tubes; the provision of such an arrangement in which the tubes are so arranged that a central core area of the exchanger is free of tubes thereby to facilitate better distribution of flow; the provision of such a tube arrangement wherein the tubes are arranged in different patterns which produce an equidistant radial fluid flow path regardless of the direction of fluid flow; the provision of such a tube arrangement to produce a uniform heat transfer rate through the heat exchanger, and to obtain a uniform shellside distribution of flow, this uniformity of fluid flow producing a uniform thermal expansion of the tubes and reduced stress forces within the heat exchanger; the provision of such a tube arrangement to prevent acoustical noise and harmful vibrations which can result from tube bundle resonance caused by vortex shedding, and various tube layout geometry; the provision of such a heat exchanger to have an inwardly rather than an outwardly tending expansion joint thereby to save space; the provision of such a tube and shell arrangement which readily fabricated in a shop for transportation and installation at a use site thereby to be lower cost than such prior art arrangements which were only manufacturable on site; and, the provision of such an arrangement which is usable in place of conventional arrangements presently used in heat exchangers.

In accordance with the invention, generally stated, a heat exchange apparatus comprises a shell having a fluid inlet and a fluid outlet A plurality of heat exchange tubes are housed in the shell. The tubes extend parallel to each other substantially the length of the shell. The tubes are arranged such that there is a central core devoid of tubes, an inner layer of tubes surrounding the central core, and an outer layer of tubes surrounding the inner layer. The inner and outer layers of tubes are segmented, with adjoining segments having a different tube pattern. The patterns are such that fluid flowing radially outwardly from the central core has an equidistant flow path through the inner and outer layers regardless of the direction of flow. The resultant combined flow path through the inner and outer layers is such there is a uniform resistance to the passage of fluid. This uniformity in turn results in a uniform fluid flow velocity, heat transfer rate, and most importantly, uniform thermal expansion of the tubes. This reduces the stress within the heat exchanger. Baffles and end supports support the tubes installed in the shell. The baffles and end supports are arranged such that they produce a serpentine fluid flow path through the shell along the length of the tubes thereby to further increase heat transfer Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENT

Figure 1:
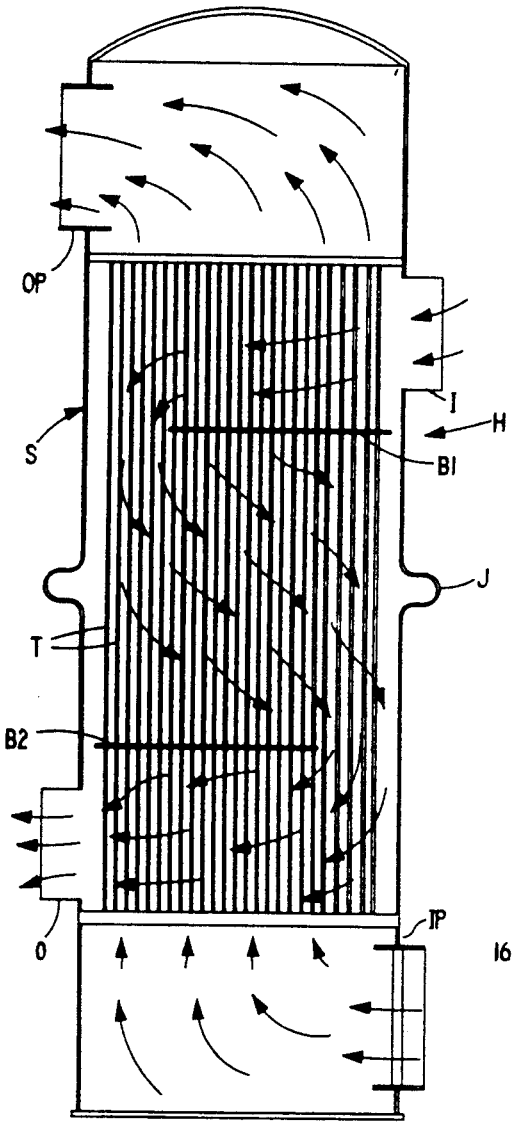
FIG. 1 PRIOR ART
FIG. 1 is a sectional view of a conventional shell and tube heat exchanger.
Figure 2:
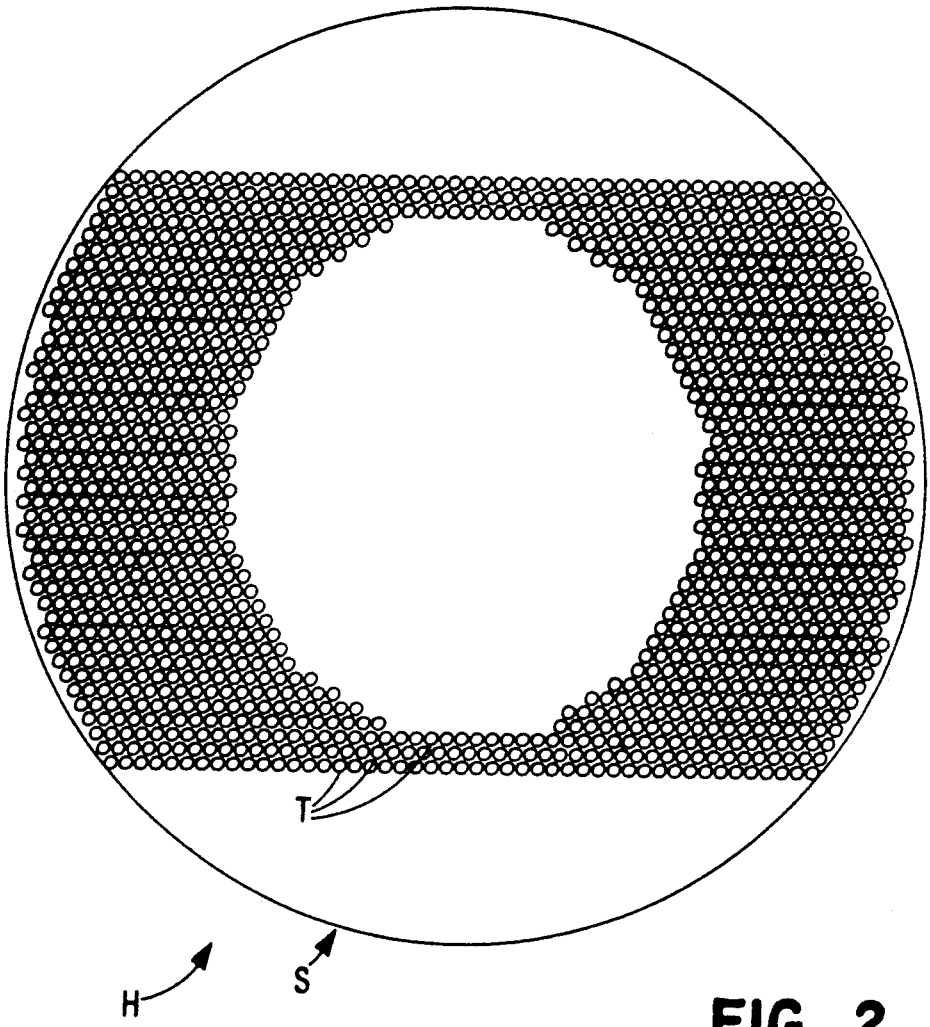
FIG. 2 PRIOR ART
FIG. 2 is a plan view of a conventional tube layout in the heat exchanger of FIG. 1.

Referring to the drawings, a conventional heat exchanger H is shown in FIG. 1. This heat exchanger has a circular shell S in which is arranged a plurality of heat exchanger tubes T. An example of the arrangement of tubes T is shown in FIG. 2. Shell S has a fluid inlet I at its upper end and an outlet O at its lower end. The heat exchange gas enters through a plenum IP at the base of the shell, flows upwardly the tubes in a heat exchange relationship with the fluid, and exits the heat exchanger through an outlet plenum OP at the upper end of the shell. The heat exchange tubes are supported at their upper and lower ends and by respective baffles B1 and B2 at points intermediate the length of the tubes. Baffle B1 extends substantially, but not wholly across the inside of shell S from side of the shell. Baffle B2 is similarly shaped and extends across the inside of the shell from the opposite side. Accordingly, the baffle arrangement forces the fluid to flow on a serpentine path through the heat exchanger. This increases the heat exchange path length, the amount of fluid turbulance, and consequently, the amount of heat exchange which occurs.

Shell S also has an expansion joint as indicated at J in FIG. 1. The joint creates a circumferential bulge in the outer surface of the shell and accordingly increases the overall diameter of the heat exchanger. Depending upon the size of the expansion joint, this has the drawback of limiting those areas in which heat exchanger H can be used. A further problem is the lack of portability of the heat exchanger. This means the unit must be fabricated on-site rather than in a shop. This greatly adds to the cost of the heat exchanger.

Figure 3:
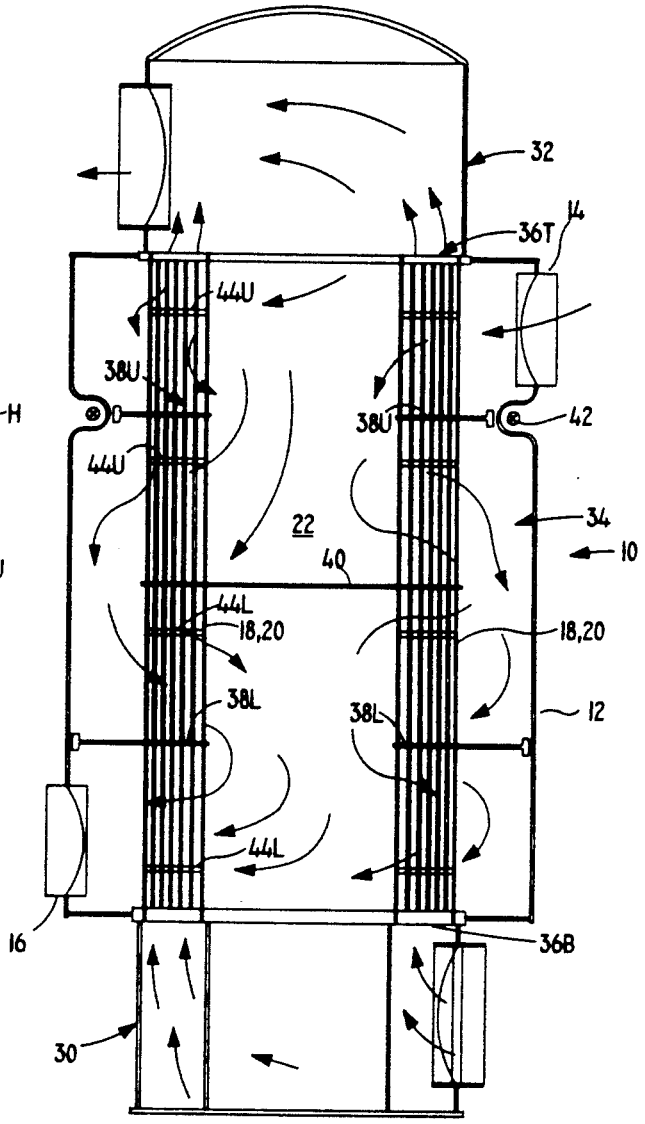
FIG. 3 is a sectional view of an improved shell and tube heat exchanger of the present invention.

Referring to FIG. 3, a heat exchanger 10 of the present invention is shown to have a shell 12. Shell 12 is a hollow circular shell having a fluid inlet 14 at its upper end, as viewed in FIG. 3, and a fluid outlet 16 at its lower end. A plurality of heat exchange tubes 18, 20 (see FIGS. 4–6) are housed in the shell. Tubes 18, 20 extend parallel to each other substantially the length of the shell. The tubes are circular in cross-section, have the same outer diameter, and are all generally the same length. Also, heat exchanger 10 can be used as a gas-gas heat exchanger, or as a liquid-gas, liquid-liquid heat exchanger. As shown in the drawings, the tubes are arranged such that there is a central core 22 which unlike many prior heat exchangers is devoid of tubes. The tubes are preferably arranged such that there is an inner layer 24 of tubes surrounding the central core, and an outer layer 26 of tubes surrounding the inner layer.

Each layer of tubes is divided into a plurality of arcuate segments. Layer 24 is divided into twelve segments 28A–28L, and layer 26 into twelve segments 30A–30L. The segments in layer 24 subscribe the same arc as the corresponding segments in layer 26. It is a particular feature of the invention that the tubes in one segment be arranged in a different tube pattern than the tubes in the adjoining arcuate (circumferential) and radial segments. Thus, for example, the tubes in segment 28A of layer 24 are arranged in a different pattern than the tubes in the adjacent arcuate segments 28B and 28L. They are also arranged in a different pattern from the tubes in the adjacent radial segment 30A.

Figure 5:
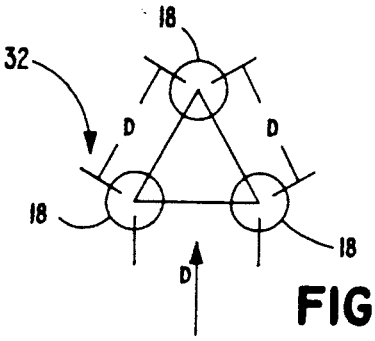
FIG. 5 is a plan view of a tube pattern in one segment of tubes to produce a first flow pattern.
Figure 6:
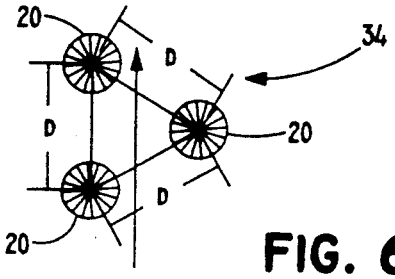
FIG. 6 is a view similar to FIG. 5 illustrating the tube pattern in the other segment of tubes to produce a second flow pattern.

Referring to FIGS. 5 and 6, the two different patterns 32 and 34 respectively, in which the tubes are arranged are shown. In FIG. 5, the tubes 18 are shown to be arranged in an equilateral triangle with the tubes being spaced a distance D apart from each other. The direction of fluid flow into the tube pattern is indicated by the arrow. As shown, the fluid must be diverted around the tubes as it flows radially outwardly from core 22. Thus, this tube pattern sets up a resistance to flow.

In FIG. 6, the tubes 20, which are identical to the tubes 18 and are represented differently only for purposes of understanding the invention, are also arranged in an equilateral triangle with the distance D separating each tube in the pattern. However, the tube pattern 34, while having the same pitched tube pattern, is rotated with respect to pattern 32. As shown by the arrow representing the direction of fluid flow from the core, there is less resistance to flow in the tube segments in which the tubes are arranged in this pattern. However, the formation of multiple layers of tubes, arranged by segments in the checkered pattern shown in FIG. 4, produces fluid flow paths of equal resistance regardless of the radial direction of flow. This, in turn, results in a constant flow velocity.

Figure 4:
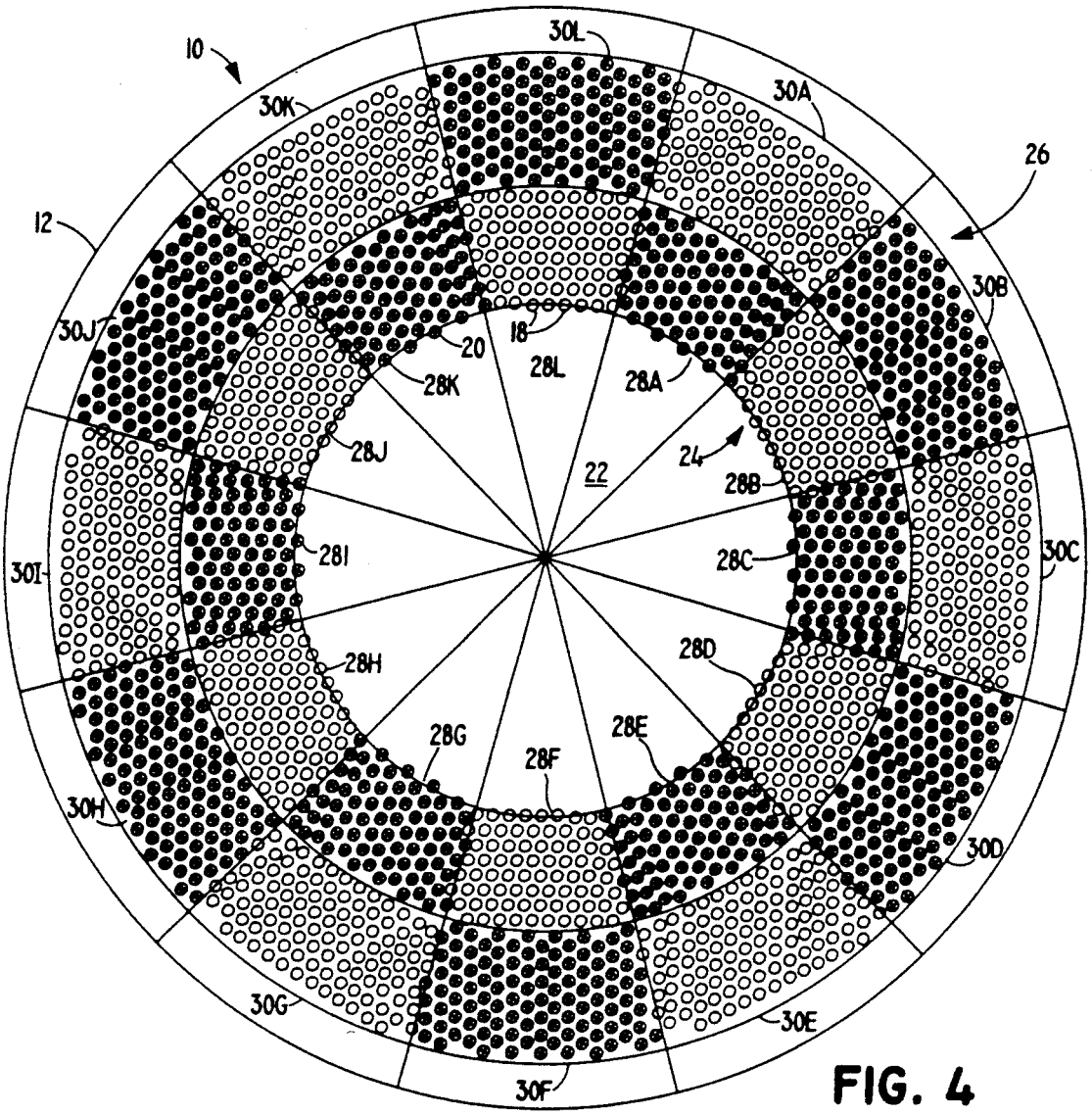
FIG. 4 is a plan view of a tube layout providing uniform fluid flow paths for uniform thermal expansion of the tubes, as well as suppression of acoustical noise and tube bundle resonance.

In FIG. 4, there are the same number of rows of tubes in each segment. Eight rows of tubes comprise each layer 24 and 26. By dividing the layers into arcuate segments, and by having the tube pattern in one segment differ from that in the adjacent arcuate and radial segments, a number of advantages are achieved. Now, unlike prior heat exchanger tube configurations, fluid flowing radially outwardly from central core 22 has an equidistant flow path from the core through the inner and outer layers to the shell regardless of the direction of flow. This not only produces more efficient heat exchange and one with a uniform heat transfer rate throughout the heat exchanger, but less stress is also placed on the tubes. This is because the thermal expansion of the tubes which results from heat exchange operations is substantially uniform throughout the heat exchanger. Also, by staggering or alternating tube patterns in the adjacent segments, the possibility of a harmful resonance condition being created is eliminated. This, even though the radial flow path from core 22 is the same in all directions. The different geometry in the adjacent tube pattern segments produces different tube vibration frequencies. Since these frequencies are unequal, they do not produce a potentially harmful compound effect. A common example of this is soldiers not marching in the same cadence when crossing a bridge.

Returning to FIG. 3, for example, heat exchanger 10 includes a heat exchange gas inlet plenum 30 located at the base of shell 12, and a gas outlet plenum 32 at the top of the shell. A support means 34 of the heat exchanger includes respective top and bottom end plates 36T and 36B in which the respective upper and lower ends of the tubes are mounted. The heat exchange gas flows into the bottom of the tubes 18, 20, upwardly through the tubes, and discharges out of the tubes at their upper end.

Support means 34 further includes upper and lower baffles 38U and 38L, and a center baffle 40. Baffle 38U is located below inlet 14 and comprises a disk having a central opening corresponding to the diameter of core 22. Baffle 38L which is located above outlet 16 is similarly constructed.

Baffle 40 comprises a disk whose diameter corresponds to that of the central core plus that of the first and second layer of tubes. The baffle is centrally positioned to block fluid flow downwardly between the tubes. Accordingly, baffle 38U directs fluid entering inlet 14 onwardly through the two layers of tubes into the core 22 portion of the tube arrangement until baffle 40 is reached. The fluid then flows radially outwardly through the two layers of tubes and down about the outside of the tubes. At the lower end of the shell, baffle 38L again directs the fluid inwardly through the tubes toward core 22. The result is a serpentine fluid flow path from inlet 14 to outlet 16. The result is a serpentine fluid flow path from inlet 14 to outlet 16. This path increases fluid turbulence and the amount of contact between the fluid and the the exchange tubes thereby enhancing the amount of heat exchange which takes place.

Shell 12 includes an expansion joint 42 to help relieve stress inherent in the heat exchanger when it is in operation. As shown in FIG. 1, joint 42 includes an inwardly turned circumferential ring extending around the shell. Such a joint design is important because, unlike prior heat exchange designs, it has, in part, the function of baffle 38U, and in addition, the function of an expansion joint. As an added benefit, joint 42 now does not increase the overall diameter of the heat exchanger. Thus the heat exchanger can be smaller in size and can be used in more confined spaces and is more readily transportable than the conventional heat exchanger shown in FIG. 1. There, the expansion joint significantly increases the overall diameter of the heat exchanger.

In addition to the baffles, the heat exchanger further includes a tube support 44U and a tube support 44L. These supports are located intermediate the respective upper and lower baffles 38U and 38L and baffle 40. These supports are not used to direct flow, but because of their presence can reduce acoustical noise. For this purpose, these supports are installed off-center, i.e., closer to one of the baffles.

Figure 7:
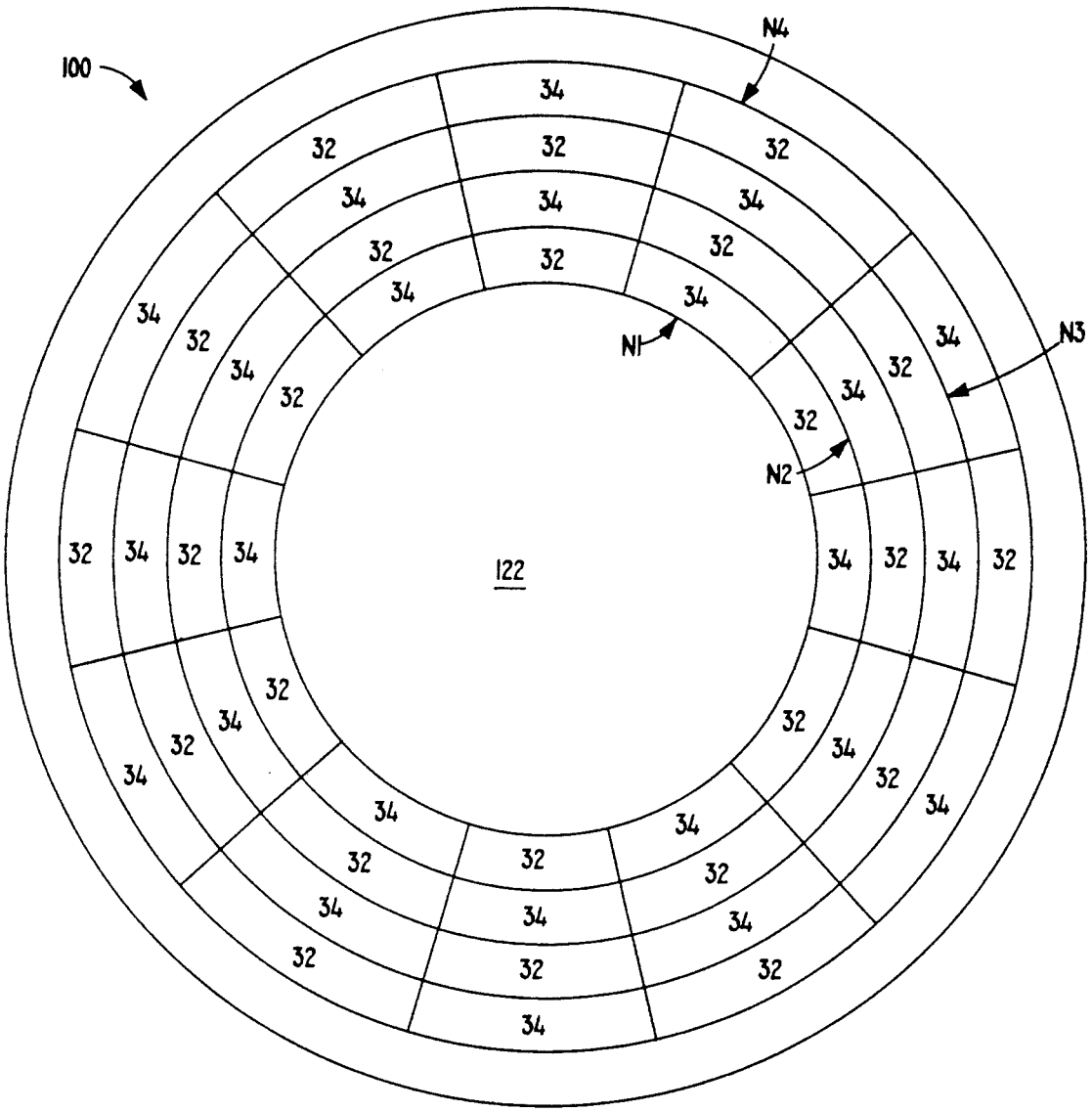
FIGS. 7 and 8 represent alternate embodiments of the present invention.
Figure 8:
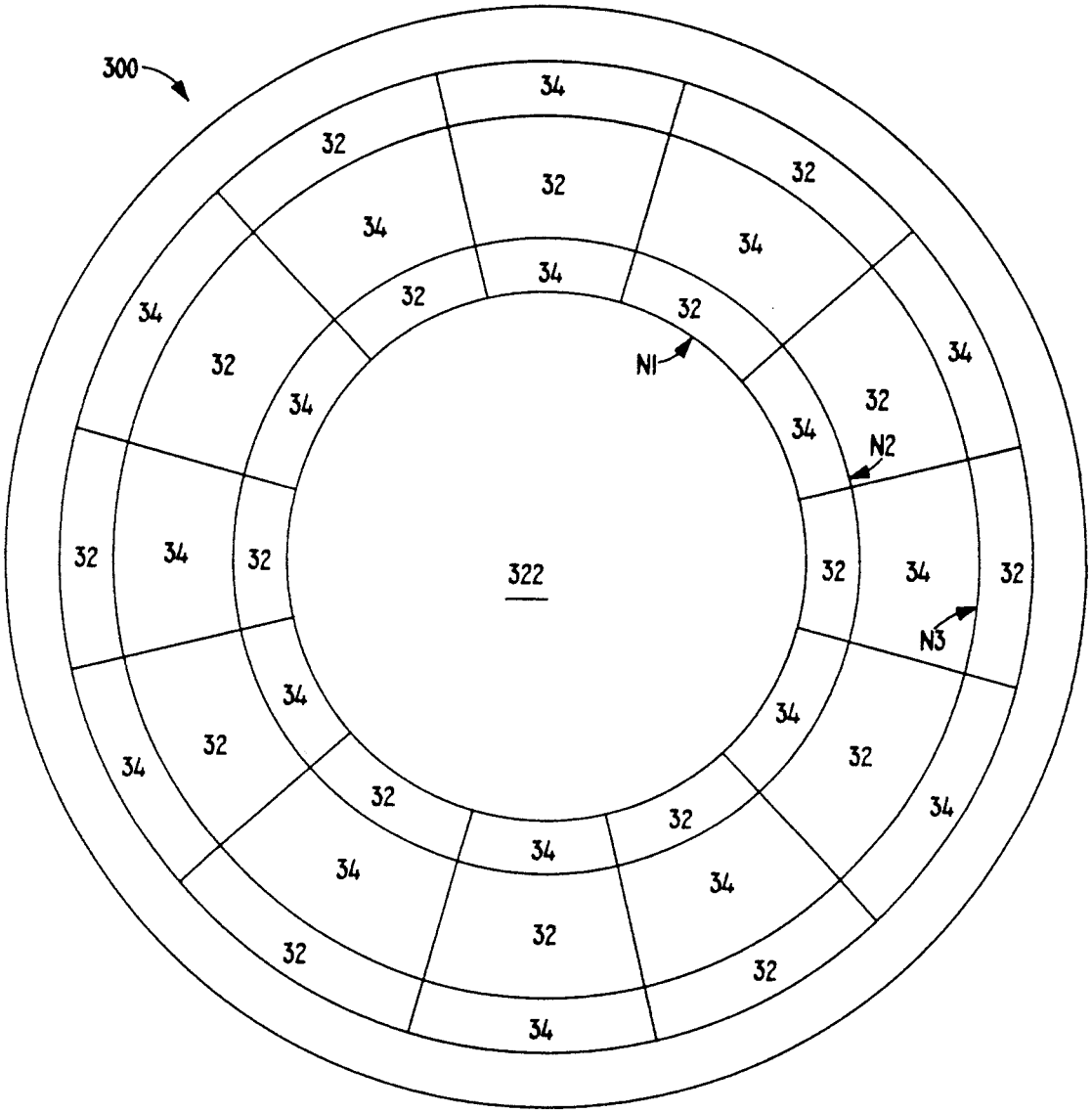

Referring to FIGS. 7-9, alternate embodiments of a heat exchanger employing the present invention are shown. The heat exchanger can, for example, have N layers. If N is an even number, for example, 2 as shown in FIG. 4; or 4, as shown in FIG. 7, there only need to be two tube patterns such as the patterns 32 and 34. In FIG. 7, a heat exchanger 100 has a hollow core 122 and four layers of tubes (N=4) N1-N4. The various arcuate and radial segments have tubes arranged in the patterns 32 and 34 shown in FIGS. 5 and 6.

Alternatively, as shown in Fig., N can be an odd number such as 3 or 5. In FIG. 8, N=3. Thus, in FIG. 8, a heat exchanger 300 has three tube layers N1-N3 respectively surrounding core 322. To provide the equidistant flow paths which have uniform resistance to flow regardless of the direction of flow, the tubes are arranged in three separate patterns P1-P3. But the layer P2 is wider than P1 and P3. Further, each layer of tubes is divided in twelve arcuate segments The arrangement of tubes in the various patterns as shown in FIG. 8, provide the desired flow characteristics. For an odd number of layers, the advantages of the invention are also realized if the number of segments in each layer are a multiple of N.

What has been described is an improved heat exchanger including an improved tube layout for the heat exchanger. The layout of tubes is such as to produce more efficient heat transfer as well as reduce potential stresses, reduce acoustical noise, and eliminate tube bundle resonance. Particularly with respect to the tube arrangement, the tubes are so arranged that a central core area of the exchanger is free of tubes. Further, the tubes are radially aligned so an equidistant radial fluid flow path exists regardless of the direction of fluid flow. Finally, the heat exchanger has an inwardly rather than an outwardly extending expansion joint which makes the heat exchanger smaller in diameter than conventional heat exchangers so it is more readily shop fabricated for transportation to a use site.

In view of the foregoing, it will be seen that several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. Heat exchange apparatus comprising:

a shell having a fluid inlet and a fluid outlet;

a plurality of heat exchange tubes housed in the shell, said tubes extending parallel to each other substantially the length of the shell, the tubes being arranged such that there is a central core devoid of tubes, an inner layer of tubes surrounding the central core, and an outer layer of tubes surrounding the inner layer, each layer of tubes being divided into a plurality of arcuate segments with the tubes in one segment being arranged in a different pattern from those in the adjacent circumferential and radial segments, the respective arrangements of tubes being such that fluid flowing inwardly to or outwardly from the central core through both layers has an equidistant flow path and provides a uniform resistance to flow regardless of the direction of flow; and, means for supporting the tubes installed in the shell.

2. The apparatus of claim 1 wherein the tubes are circular in cross-section.

3. The apparatus of claim 2 wherein all of the tubes have the same outer diameter and the same length.

4. The apparatus of claim 3 wherein the support means comprises baffles located along the length of the tubes for supporting the tubes and for directing fluid flow along the length of the tubes in a serpentine fashion.

5. The apparatus of claim 4 wherein the support means further includes supports located at the respective ends of the tubes, and intermediate the baffles, for further supporting the tubes.

6. The apparatus of claim 5 further including additional supports for the tubes located intermediate the baffles and the aforesaid intermediate support, the additional supports being offset in one direction or the other with respect to the baffles and intermediate support.

7. The apparatus of claim 5 wherein the tubes are of a material which allows either a hot or a cold fluid to be flowed through the tubes depending upon the type of heat transfer for which the apparatus is being used.

8. The apparatus of claim 1 wherein the tubes comprising both the inner and outer layer are each arranged in a generally circular pattern with the tubes in one arcuate segment being arranged in one pattern and the tubes in the adjoining segments in a second pattern.

9. The apparatus of claim 8 wherein the tubes in either arrangement are arranged in a triangular pattern in which the tubes are equidistantly spaced from each other.

10. The apparatus of claim 9 wherein the triangular tube pattern of one segment has one pitch and the triangular tube pattern in the adjoining segments has the same pitch, however, the tube pattern in one segment is rotated with respect to that in the adjoining segments.

11. The apparatus of claim 1 wherein the shell includes an expansion joint.

12. The apparatus of claim 11 wherein the expansion joint extends circumferentially of the shell and extends inwardly thereof thereby to maintain the diameter of the shell at a minimum.

13. The apparatus of claim 12 wherein the expansion joint functions as a baffle plate.

14. Heat exchange apparatus comprising:

a shell having a fluid inlet and a fluid outlet;

a plurality of heat exchange tubes housed in the shell and extending parallel to each other substantially the length of the shell; and, means for supporting the tubes in the shell, wherein the tubes are arranged in a circular pattern such that there is a central core devoid of tubes and N layers of tubes surrounding the core, the tubes in each layer being divided into a plurality of arcuate segments with the tubes in one segment being arranged in a different pattern from those in the adjacent circumferential and radial segments, the respective arrangements of tubes being such that fluid flowing inwardly to or outwardly from the central core, in any direction, through the layers, has an equidistant flow path and meets a uniform resistance to flow.

15. The heat exchanger of claim 14 wherein N is an even number.

16. The heat exchanger of claim 14 wherein N is an even number and there are two different patterns of tubes.

17. The heat exchanger of claim 14 wherein N is an odd number and the number of different patterns in which the tubes are arranged is also equal to 2.

18. The heat exchanger of claim 17 wherein the number of arcuate segments of tubes in each layer is N or a multiple of N, there being the same number of segments in each layer.

19. The heat exchanger of claim 17 wherein at least one of the layers of tubes is thicker than the other layers.

* * * * *